US006509687B1

(12) United States Patent
Natarajan et al.

(10) Patent No.: US 6,509,687 B1
(45) Date of Patent: Jan. 21, 2003

(54) METAL/DIELECTRIC LAMINATE WITH ELECTRODES AND PROCESS THEREOF

(75) Inventors: Govindarajan Natarajan, Pleasant Valley, NY (US); Raschid J. Bezama, Mahopac, NY (US); John U. Knickerbocker, Hopewell Junction, NY (US); Robert W. Pasco, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/450,530

(22) Filed: Nov. 30, 1999

(51) Int. Cl.[7] ..... H01J 29/64
(52) U.S. Cl. ..... 313/495; 313/422; 313/431
(58) Field of Search ..... 313/495, 496, 313/497, 422, 431, 336, 309, 351; 315/169.1, 169.3, 169.4

(56) References Cited

U.S. PATENT DOCUMENTS

| | | | | |
|---|---|---|---|---|
| 4,023,057 A | | 5/1977 | Meckling | |
| 4,138,236 A | | 2/1979 | Haberey | |
| 4,540,500 A | | 9/1985 | Torii et al. | |
| 4,663,559 A | * | 5/1987 | Christensen | 313/336 |
| 4,955,681 A | * | 9/1990 | Sekihara et al. | 313/495 |
| 5,227,691 A | * | 7/1993 | Murai et al. | 313/497 X |
| 5,857,883 A | | 1/1999 | Knickerbocker et al. | |
| 5,917,277 A | | 6/1999 | Knox et al. | |
| 5,932,498 A | | 8/1999 | Beetson et al. | |

FOREIGN PATENT DOCUMENTS

| | | |
|---|---|---|
| GB | 2 304 981 A | 8/1999 |
| JP | 60093742 | 5/1985 |

* cited by examiner

*Primary Examiner*—Ashok Patel
(74) *Attorney, Agent, or Firm*—Margaret A. Pepper

(57) ABSTRACT

The present invention relates generally to a new electrode forming metal/magnetic-ceramic laminate with through-holes and process thereof. More particularly, the invention encompasses a new process for fabrication of a large area ceramic laminate magnet with a significant number of holes, integrated metal plate(s) and co-sintered electrodes for electron and electron beam control. The present invention also relates to a magnetic matrix display (MMD), and electron beam source, and methods of manufacture thereof.

43 Claims, 2 Drawing Sheets

METAL/DIELECTRIC LAMINATE WITH ELECTRODES AND PROCESS THEREOF

FIELD OF THE INVENTION

The present invention relates generally to a new electrode forming metal/magnetic-ceramic laminate with through-holes and process thereof. More particularly, the invention encompasses a new process for fabrication of a large area ceramic laminate with integrated metal plate(s) and co-sintered electrodes for electron and electron beam control. The present invention also relates to a magnetic matrix display (MMD) electron beam source, and methods of manufacture thereof.

BACKGROUND OF THE INVENTION

A magnetic matrix display is particularly, although not exclusively, useful in display applications, especially flat panel display applications. Such flat panel display applications include television receivers, visual display units for computers, especially, although not exclusively, portable and/or desktop computers, personal organizers, communications equipment, wall monitor, portable game unit, virtual reality visors and the like. Flat panel display devices based on a magnetic matrix electron beam source hereinafter may be referred to as Magnetic Matrix Displays (MMD).

Conventional flat panel displays, such as liquid crystal display panels, and field emission displays, provide one display technology. However, these conventional flat panel displays are complicated and costly to manufacture, because they involve a relatively high level of semiconductor fabrication, delicate materials, and high tolerance requirements.

U.S. patent application Ser. No. 08/695,856, filed on Aug. 9, 1996, entitled "ELECTRON SOURCE", which also corresponds to U.K. Patent Application Serial No. 2304981, assigned to the assignee of the instant Patent Application and the disclosure of which is incorporated herein by reference, discloses a magnetic matrix electron source and methods of manufacture thereof. Also disclosed is the application of the magnetic matrix electron source in display applications, such as, for example, flat panel display, displays for television receivers, visual display units for computers, to name a few. Also disclosed is a magnetic matrix display having a cathode for emitting electrons, a permanent magnet with a two dimensional array of channels extending between opposite poles of the magnet, the direction of magnetization being from the surface facing the cathode to the opposing surface. The magnet generates, in each channel, a magnetic field for directing electrons from the cathode means into an electron beam. The display also has a screen for receiving the electron beam from each channel. The screen has a phosphor coating facing the side of the magnet remote from the cathode, the phosphor coating comprising a plurality of pixels each corresponding to a different channel. There are grid electrode means disposed between the cathode means and the magnet for controlling the flow of electrons from the cathode means into each channel. The two dimensional array of channels are regularly spaced on an X-Y grid. The magnet area is large compared with its thickness. The flat panel display devices based on a magnetic matrix electron source is referred to as MMD (Magnetic Matrix Display).

The permanent magnet is used to form substantially linear, high intensity fields in the channels or magnetic apertures for the purpose of collimating the electrons passing through the aperture. The permanent magnet is insulating, or at most, has a small conductivity, so as to allow a field gradient along the length of the aperture. The placement of the beam so formed, on the phosphor coating, is largely dependent on the physical location of the apertures in the permanent magnet.

In operation, these electron beams are directed at a phosphor screen and collision of the electron beam with the phosphor results in light output, the intensity being proportional to the incident beam current (for a fixed final anode voltage). For color displays, three different colored phosphors (such as red, green and blue) are used and color is obtained by selective mixing of these three primary colors.

For accurate color reproduction, the location of the electron beams on the appropriate colored phosphor is essential.

Some degree of error may be tolerated by using "black matrix" to separate the different phosphors. This material acts to delimit individual phosphor colors and also enhances the contrast ratio of the displayed image by making the display faceplate appear darker. However, if the electron beam is misplaced relative to the phosphor, initially the light output from the phosphor is reduced (due to loss of beam current to the black matrix) and this will be visible as a luminance non-uniformity. If the beam is subject to a more severe placement error, it may stray onto a different colored phosphor to that for which it was intended and start to produce visible quantities of light output. Thus the misplaced electron beam is actually producing the wrong light output color. This is called a purity error and is a most undesirable display artifact. For a 0.3 mm pixel, typical phosphor widths are 67 $\mu$m with 33 $\mu$m black matrix between them.

It will be apparent that a very precise alignment is required between the magnet used to form the electron beams and the glass plate used to carry the phosphors that receive the electron beams. Further, this precise alignment must be maintained over a range of different operating conditions (high and low brightness, variable ambient temperature etc).

A number of other magnet characteristics are also important when considering application for a display, such as, for example:

1. It is generally accepted that the displayed image is formed by a regular array of pixels. These pixels are conventionally placed on a square or rectangular grid. In order to retain compatibility with graphics adaptors the magnet must thus present the electron beams on such an array.
2. In operation, the spacing between the grids used for bias and modulation of the electron beam and the electron source determines the current carried in the electron beam. Variations of this spacing will lead to variations in beam current and so to changes in light output from the phosphor screen. Hence it is a requirement that the magnet, which is used as a carrier for these bias and modulation grids, maintain a known spacing to the electron source. To avoid constructional difficulties, the magnet should be flat.
3. The display will be subject to mechanical forces, especially during shipment. The magnet must retain structural integrity over the allowable range of stresses it may encounter. A commonly accepted level is an equivalent acceleration of about 30G (294 $ms^{-2}$).

One further requirement is that since the magnet is to be used within the display, which is evacuated, it should not contain any organic components which may be released over the life of the display, so degrading the quality of vacuum or poisoning the cathode.

Finally, the magnet is magnetized in the direction of the apertures, that is the poles correspond to the faces of the magnet.

The manufacture of such a magnet that satisfies the above conditions is not possible by the use of previously known manufacturing methods. Certainly a magnet (ferrite, for example) of the desired size without apertures is readily obtainable but the presence of the apertures causes some problems.

If the apertures in the magnet are to be formed after the ferrite plate has been sintered, either laser or mechanical drilling may be used. However, the sintered ferrite is a very hard material and forming the apertures by this technique will be a costly and lengthy process - unsuitable for a manufacturing process.

Holes could be formed in the ferrite at the green-sheet stage before sintering by known punching/drilling methods typical of multi-layer ceramics for microelectronics applications. However, during sintering a number of problems would be anticipated, such as, for example:

The magnet plate will be subject to uneven shrinkage leading to the holes "moving"—an unequal radial displacement from their nominal positions;

The magnet itself is likely to "bow" such that it forms a section of a large diameter sphere;

Cracking is likely to occur between adjacent apertures due to the apertures acting as stress concentrators; or If, to obtain the desired aperture length, multiple thin sheets are stacked on top of one another, misalignment may occur in stacking which could lead to no "line of sight" through the apertures.

A further problem is that ferrite is a hard but not tough material and the presence of the apertures significantly reduces the mechanical strength of the plate. Thus, during shipment when large shocks may be encountered, complete mechanical failure of the magnet is a distinct possibility.

U.S. Pat. No. 4,138,236 discloses a method of bonding hard and/or soft magnetic ferrite parts with an oxide glass. The oxide glass may be applied prior to or after pre-firing or main firing. Finally, the ferrite parts are fused at temperatures in excess of the glass softening point.

U.S. Pat. No. 4,540,500 discloses a low temperature sinterable oxide magnetic material prepared by adding 0.1 to 5.0 percent by weight of glass to ferrite. In some situations, the sintering temperature can be reduced to about 1,000° C. or less.

U.S. Pat. No. 4,023,057 discloses a compound magnet for a motor stator having a laminated structure that includes thin, flexible magnets made from permanently magnetizable particles, such as barium ferrite, that are embedded in a flexible matrix, such as rubber. Various laminated arrangements are contemplated for producing more intense magnetic fields and thin metal spacers are used in most laminated structures to collapse the respective fields of the flexible magnetic to increase the flux density at the resultant poles and to orient the permanent magnetic fields in the magnetic circuit of the motor.

Published Japanese Patent Application No. JP60093742 discloses a display having a focus electrode with a conductive magnetic body and a sputtered metal coating on one surface of the magnet body. The conductivity is required for the focusing electrode to perform its function. The coating is sputtered and so is a thin coating, not substantially adding to the mechanical structure of the magnet. Each of the holes in the magnet has a number of electron beams passing through it.

U.S. patent application Ser. No. 08/823,669, filed on Mar. 24, 1997, entitled "MAGNET AND METHOD FOR MANUFACTURING A MAGNET", assigned to the assignee of the instant Patent Application and the disclosure of which is incorporated herein by reference, discloses a magnet-photosensitive glass composite and methods thereof.

U.S. Pat. No. 5,857,883, (Knickerbocker et al.), entitled "Method of Forming Perforated Metal/Ferrite Laminated Magnet", assigned to the assignee of the instant Patent Application and the disclosure of which is incorporated herein by reference, discloses a process for fabrication of a large area laminate magnet with a significant number of perforated holes, integrated metal plate(s) and electrodes for electron and electron beam control.

PURPOSES AND SUMMARY OF THE INVENTION

The invention is a novel structure and process for metal/magnetic-ceramic laminate with through-holes.

Therefore, one purpose of this invention is to provide a structure and a process that will form metal/magnetic-ceramic laminate.

Another purpose of this invention is to provide a structure and a process that will provide metal/magnetic-ceramic laminate with through-holes.

Yet another purpose of this invention is to use the metal/magnetic-ceramic laminate as a mask to create an image on at least one glass plate to form multi-phosphors (red, green, blue) material which receives an electron beam to create a display.

Still another purpose of this invention is to provide a structure through which one or more collimated beam(s) of electrons can be formed using the ceramic/magnetic laminate.

Yet another purpose of this invention is to provide a structure that can be used with any electron sensitive process.

Still yet another purpose of the invention is to provide a laminated metal/magnetic-ceramic that has a plurality of openings for guiding electrons and/or electron beams.

Another purpose of the invention is to provide a metal/magnetic-ceramic that has co-sintered electrodes.

Still another purpose of the invention is to form co-sintered electrodes from the laminated metal structure.

Still yet another purpose of the invention is to have a metal in metal/magnetic-ceramic structure to allow lower temperature sintering as well as form co-sintered electrodes.

Therefore, in one aspect this invention comprises a process of forming unsintered electrode forming metal/ferrite laminate magnet, comprising:

(a) forming at least one opening in an electrode forming metal sheet having a first surface and a second surface, (b) securing at least one dielectric layer to at least a portion of said first surface of said metal sheet, (c) securing at least one ceramic magnet layer to at least a portion of said at least one dielectric layer, (d) forming at least one opening through said ceramic magnet layer and said dielectric layer, such that at least a portion of said opening overlaps at least a portion of said opening in said metal sheet, and thereby forming said unsintered electrode forming metal/ferrite laminate magnet.

In another aspect this invention comprises a process of forming unsintered metal/ferrite laminate magnet, comprising:

(a) forming at least one first opening in an electrode forming metal sheet having a first surface and a second surface, (b) securing at least one dielectric layer to at least a portion of said first surface of said metal sheet, (c) securing at least one ceramic magnet layer to at least a portion of said at least one dielectric layer, (d) forming a second opening using said first opening as a guide, such that at least a portion of said second opening overlaps at least a portion of said first opening in said metal sheet, and thereby forming said unsintered metal/ferrite laminate magnet.

In still another aspect this invention comprises a process of forming a sintered electrode forming metal/ferrite laminate magnet, comprising:

(a) forming at least one opening in an electrode forming metal sheet having a first surface and a second surface, (b) securing at least one dielectric layer to at least a portion of said first surface of said metal sheet, (c) securing at least one ceramic magnet layer to at least a portion of said at least one dielectric layer, (d) forming at least one opening through said ceramic magnet layer and said dielectric layer, such that at least a portion of said opening overlaps at least a portion of said opening in said metal sheet, and sintering the same to form said sintered metal/ferrite laminate magnet.

In yet another aspect this invention comprises a display device comprising, a screen for receiving electrons from an electron source, said screen having a phosphor coating facing said side of a magnet remote from said cathode; and means for supplying control signals to a grid electrode means and an anode means to selectively control flow of electrons from said cathode to said phosphor coating via at least one magnetic channel, and thereby producing an image on said screen, and wherein said electrode forming metal/ferrite laminate magnet comprises of at least one metal sheet, at least one dielectric layer and at least one ceramic magnet layer, and each of said layers have at least one opening in registration with each other.

In still yet another aspect this invention comprises a display device comprising, a screen for receiving electrons from at least one electron source, said screen having a phosphor coating facing said side of a magnet remote from said cathode, said phosphor coating comprising a plurality of groups of different phosphors, said groups being arranged in a repetitive pattern, each group corresponding to a different channel; means for supplying control signals to said grid electrode means and said anode means to selectively control flow of electrons from said cathode to said phosphor coating via said channel; and deflection means for supplying deflection signals to said anode means to sequentially address electrons emerging from said channel to different ones of said phosphors for said phosphor coating thereby to produce a color image on said screen, and wherein said metal/ferrite laminate magnet comprises of at least one metal sheet, at least one dielectric layer and at least one ceramic magnet layer, and each of said layers have at least one opening in registration with each other.

In still another aspect this invention comprises an apparatus comprising, at least one cathode means, at least one electrode forming metal/ferrite laminate magnet, wherein said magnet has at least one magnetic channel extending between opposite poles of said magnet, wherein each magnetic channel allows the flow of electrons received from said cathode means into an electron beam, grid electrode means disposed between said cathode means and said magnet for controlling flow of electrons from said cathode means into said magnetic channel, and, anode means remote from said cathode for accelerating electrons through said magnetic channel, and wherein said electrode forming metal/ferrite laminate magnet comprises of at least one metal sheet, at least one dielectric layer and at least one ceramic magnet layer, and each of said layers have at least one opening in registration with each other.

BRIEF DESCRIPTION OF THE DRAWINGS

The features of the invention believed to be novel and the elements characteristic of the invention are set forth with particularity in the appended claims. The drawings are for illustration purposes only and are not drawn to scale. Furthermore, like numbers represent like features in the drawings. The invention however, both as to organization and method of operation, may best be understood by reference to the detailed description which follows taken in conjunction with the accompanying drawings in which:

DETAILED DESCRIPTION OF THE INVENTION

Figure 1:
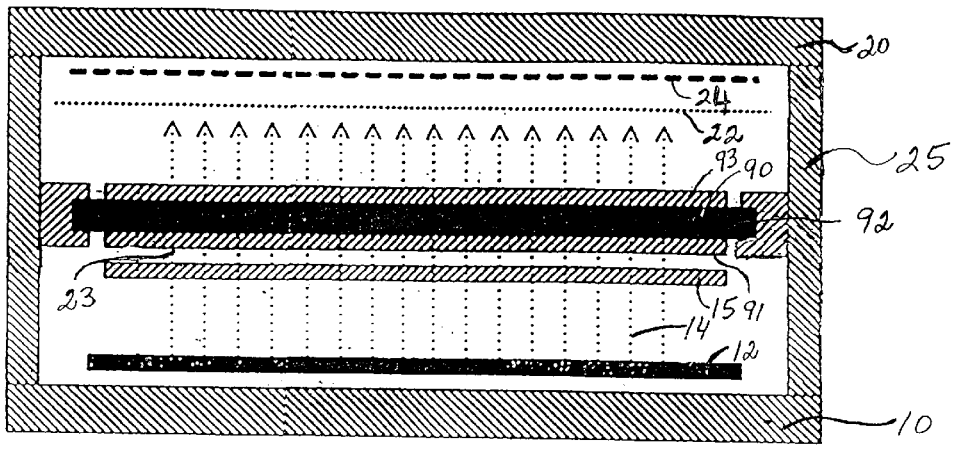
FIG. 1, illustrates a preferred embodiment of this invention where at least one magnetic-ceramic laminate directs at least one electron beam from a cathode.

In accordance with the present invention, there is provided an electron source comprising at least one cathode means and at least one magnetic-ceramic laminate with grid electrodes. The magnets are perforated by at least one channel extending between opposite poles of the magnet, wherein each channel in the magnet can direct or guide electrons received from the cathode means into an electron beam towards a target with no possible overlap.

In a preferred embodiment of the present invention, the electron source comprises co-sintered grid electrode means disposed between the cathode means and the ceramic magnets for controlling flow of electrons from the cathode means into the magnetic channels.

The magnetic channels are preferably disposed in the ceramic magnet in a two dimensional array of rows and columns. However, a person skilled in the art could also customize the dimensional array.

Preferably, the co-sintered grid electrode means comprise a plurality of parallel row conductors and a plurality of parallel column conductors arranged orthogonally to, and insulated from, the row conductors, each channel being located at a different intersection of a row conductor and a column conductor.

The grid electrode means may be disposed on the surface of the cathode means facing the magnet. Alternatively, in the present invention the grid electrode means may be disposed on the surface of the magnet facing the cathode means.

The cathode means may comprise a cold emission device such as a field emission device. Alternatively, the cathode means may comprise a photo-cathode. In some embodiments of the present invention, the cathode may comprise a thermionic emission device.

In an embodiment of the invention, each channel may have a cross-section which varies in shape and/or area along its length.

In another embodiment of the present invention, each channel may be tapered, the end of the channel having the largest surface area facing the cathode means.

The laminate with magnet(s) preferably comprises ferrite. In some embodiments of the present invention, the magnet may comprise a ceramic material. In other embodiments of the present invention, the magnet may also comprise a binder. The binder may be organic or inorganic. Preferably, the binder comprises an inorganic glass composite, containing glass forming oxides for optimized properties in fabrication and use.

In one embodiment of the present invention, the channel is circular in cross-section. In other embodiments of the present invention, the cross-section of the channel could be selected from a group comprising, triangular, rectangular, polygonal, to name a few. The corners and edges of each channel could also be chamfered.

The present invention also extends to display devices and a computer system comprising: memory means; data transfer means for transferring data to and from the memory means; processor means for processing data stored in the memory means; and a display device comprising the electron source as hereinbefore described for displaying data processed by the processor means.

It will further be appreciated that the present invention extends to a print-head comprising an electron source as hereinbefore described. Still further, it will be appreciated that the present invention extends to document processing apparatus comprising such a print-head, together with means for supplying data to the print-head to produce a printed record in dependence on the data.

The present invention in another embodiment is a triode device comprising: cathode means; a magnetic laminate perforated by at least a channel extending between opposite poles of the magnet wherein each channel forms electrons received from the cathode means into an electron beam; co-sintered grid electrode means disposed between the cathode means and the magnet for controlling flow of electrons from the cathode means into the channels; and, anode means disposed on the surface of the magnet remote from the cathode for accelerating electrons through the channels towards the glass plate containing phosphors.

The present invention is also a process for making an electron beam collimator, comprising: forming perforated metal plates, perforated green sheets of dielectric and ferrite containing compositions, forming co-sintered metal electrode conductors and composite magnetic structure to produce a laminate with desired characteristics.

The process may comprise mixing the ferrite with a binder prior to forming the discretely magnetic structure. Preferably, the binder comprises glass particles.

The process may also comprise depositing anode means on a perforated face of the magnet(s).

Preferably, the process comprises co-sintered control grid means on the face of the laminate remote from the face carrying the anode means.

At least one of the steps of forming the anode means and the steps of forming the control grid means may comprise photo-processing or chemical etching. Alternatively, plating, screen printing or decal transfer may be used for depositing anode means and control grid means.

The present invention could also be a process for making a display device comprising: making an electron source according to the process hereinbefore described; positioning a phosphor coated screen adjacent to the face of the magnet carrying the anode means; and, evacuating spaces between the cathode means and between the magnet and the magnet and the screen.

The present invention could also be a process for addressing pixels of a display screen having a plurality of pixels, each pixel having successively first, second, and third sub-pixels in line, the process comprising: generating a plurality of electron beams, each electron beam corresponding to a different one of the pixels; and, deflecting each electron beam to repetitively address the sub-pixels of the corresponding pixel in the sequence second pixel, first pixel, second pixel, third pixel.

Referring now to the figures, such as, FIG. 1, a color magnetic matrix display (MMD) of the present invention comprises: a first or lower plate 10, such as, a glass plate 10, having at least one cathode 12, and a second or upper plate or screen 20, such as, a glass plate 20, having at least one coating of at least one phosphor pixel or dots or stripes 24. It is preferred that the phosphor coatings 24, are sequentially arranged red, green and blue phosphor coatings 24, facing the cathode 12. The phosphor coatings 24, are made from preferably high voltage phosphors. At least one anode layer 22, is disposed on or adjacent to the phosphor coating 24.

At least one composite magnetic plate or sheet 90, is disposed between the plates 10 and 20. The composite magnetic sheet 90, has a first or lower surface electrode 91, and an upper or second surface electrode 93, having a ceramic magnet layer 92, is perforated by a two dimension matrix of perforation or "pixel wells" 23. Electron beams 14, are channeled through the "pixel wells" 23. At least one bias 15, which is preferably near or on the first electrode 91, can be used to channel the electrons in the electron beam 14. A housing 25, contains and protects the different components of the color MMD.

FIGS. 2 through 7, illustrate a preferred process for the manufacture of the inventive composite magnetic plate or sheet 90, comprising at least one electrode forming co-sintered metal/magnetic-ceramic laminate.

Figure 2:
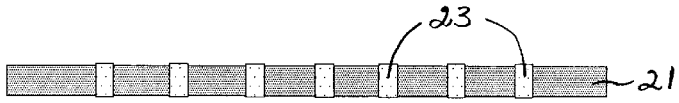
FIGS. 2, 3 and 4, illustrate a preferred process to manufacture the electrode forming magnetic-ceramic laminate of this invention.

FIG. 2, shows at least one rolled metal sheet 21, which is preferably capable of withstanding oxidizing atmospheres of up to about 1,000° C. At least one photo-resist is applied onto this metal sheet 21, which is subsequently exposed and developed to produce a pattern of holes or openings 23. These holes 23, can be made by methods well known in the art, such as, by etching with at least one etchant that attacks the metal sheet 21.

The desired array of holes 23, made in the metal sheet 21, can also be inspected to ensure that all the holes 23, are present, and that the dimensional and positional tolerances of the holes 23, are met. Hole diameter with a tolerance of about 0.3 mil and hole-to-hole pitch with a tolerance of about 0.2 mil can be achieved by this technique.

For some applications the exposed surface of the metal sheet 21, may have to be prepared to enhance the adhesion between the metal sheet 21, and the subsequent layer, such as, a dielectric layer. This could be accomplished by the deposition of or formation of selected adhesion promoting metals or oxides on one or both surfaces of the metal sheet 21. However, one could also use at least one suitable adhesive to secure at least one dielectric layer to at least one surface of the metal sheet 21.

Figure 3:
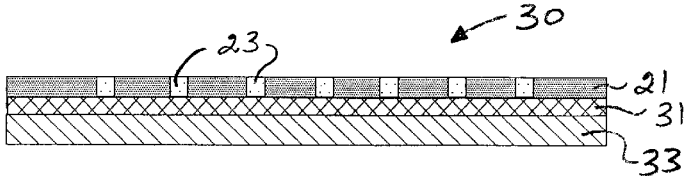

As shown in FIG. 3, a sub-laminate structure 30, is formed by combining the etched metal sheet 21, with holes 23, to at least one thin dielectric layer or sheet 31, such as, a green sheet 31, and/or at least one ceramic magnet layer 33, such as a ferrite green sheet 33, on at least one exposed surface to form a primary "green" sub-laminate structure 30. It is preferred that the sub-laminate structure 30, is formed in such a way that there is no movement between the various layers, such as, between the metal sheet 21, with holes 23, and the at least one dielectric layer 31. This can be done by the simultaneous application of heat and/or pressure to all components or layers of the sub-laminate structure 30, or by adhesively bonding the layers to the metal sheet 21. It should be appreciated that the at least one dielectric layer 31, can be on one side as shown or on both sides of the metal sheet 21, as needed.

The dielectric layer or sheet 31, of FIG. 3, can be formed in a number of ways, such as, on at least one exposed surface of the metal sheet 21, one could form at least one cast sheet 31. This could be done by combining a glass powder, organic binders, solvents and vehicles to produce a slurry capable of being cast into at least one thin dielectric sheet 31. The technology used to produce the thin dielectric sheet 31, is similar to the one used to prepare conventional multilayer ceramic greensheets. After drying, the cast sheet 31, could be cut to the proper size to form a cast dielectric layer 31, and bonded onto at least one surface of the metal sheet 21.

The insulator layer 31, could be formed by mixing at least one dielectric material to form a dielectric slurry; one would then mix, cast and dry the dielectric slurry into a dielectric green sheet; and then the dielectric green sheet could be blanked to form the dielectric layer 31.

For some applications the insulator layer 31, could be formed by mixing at least one dielectric material to form a dielectric slurry, paste or powder, and wherein the dielectric mix could be deposited onto the metal sheet 21, using at least one method selected from a group comprising spraying, screening, dry-pressing, to name a few.

After the primary unsintered sub-laminate structure 30, has been formed, holes or openings are produced in the dielectric sheet(s) 31, and/or ceramic magnet green sheet 33, using the pre-existing hole 23, in the metal sheet 21, as a guide. The holes formed in the dielectric layer 31, and/or the ceramic magnetic sheet 33, of the sub-laminate structure 30, can be made by a myriad of techniques, such as, mechanical, laser beam, electron beam, and such other techniques known to those skilled in the art.

Figure 4:
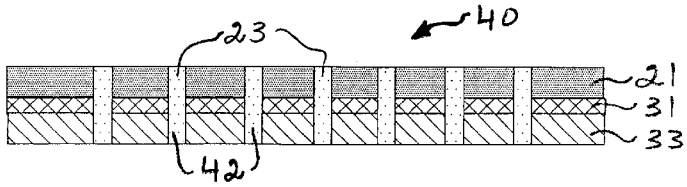

FIG. 4, shows that the unsintered sub-laminate structure 40, has now been perforated with holes or openings 42, that have been produced in the dielectric green sheet 31, and/or ceramic magnet green sheet 33, creating a dielectric green sheet 31, with holes 42, and/or ceramic magnet green sheet 33, with holes 42, that combines with the metal sheet 21, to form a perforated green laminate 40. It is preferred that the array of holes 23, in the metal sheet 21, are slightly larger than the array of holes 42, in the dielectric layer 31, to help facilitate subsequent hole formation and also to enhance the reliability of ultimate desired structure.

For most applications at least two of the unsintered metal/ferrite laminate magnet 40, could be secured to each other such that the metal sheet 21, sandwiches the dielectric material 31.

Figure 5:
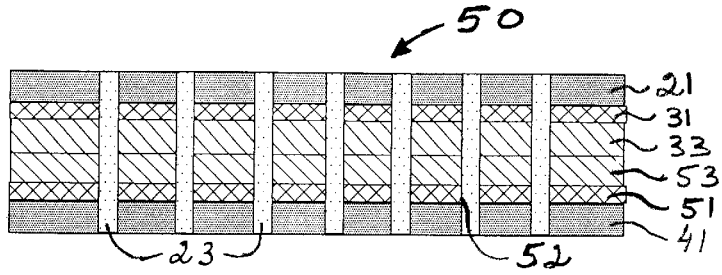
FIGS. 5, 6A and 6B, illustrate a best mode for forming magnetic-ceramic laminate of this invention.

FIG. 5, illustrates the unsintered multi-layered magnetic laminate 50, which in this case is the result of securing multiple sub-laminates 40. As shown, the top sheet metal 21, and bottom metal sheets 41, sandwich at least one dielectric layer 31 and/or 51 and at least one ferrite layer 33 and/or 53. The holes 23, 42 and 52, are now connected and stretch from one surface of the first or top metal sheet 21, to the other surface of the second or bottom metal sheet 41, creating a hole 52.

It should be noted that a plurality of perforated primary unsintered sub-laminate structures 40, may be combined into a secondary unsintered laminate structure 50, by the reapplication of heat and/or pressure to the components or by the use of an organic adhesive. In this step care must be taken to ensure the alignment of the holes 23, 42 and 52, in the various substructures.

Figure 6A:
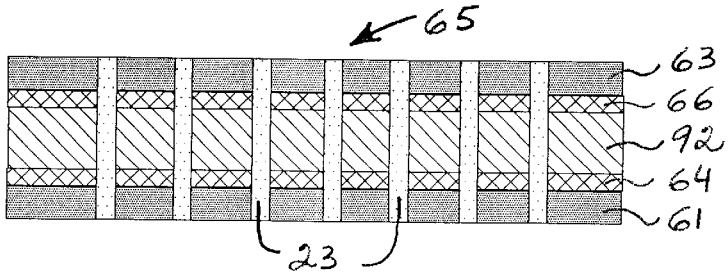
Figure 6B:
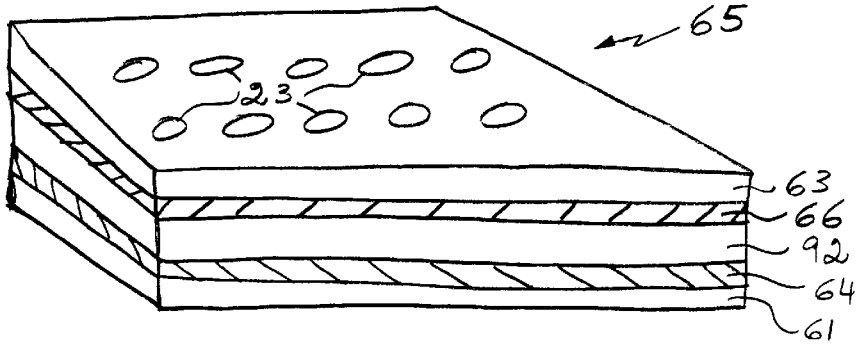

FIGS. 6A and 6B, illustrate the sintered multi-layered magnetic laminate 65, which in this case is the result of securing multiple sub-laminates 40. As shown, the top and bottom electrode forming co-sintered metal sheets 61 and 63, sandwich at least one sintered dielectric layer 64 and/or 66, and at least one sintered ferrite or ceramic magnet layer 92. The hole 23, now stretch from one surface of the first electrode forming co-sintered metal sheet 61, to the other surface of the second electrode forming co-sintered metal sheet 63, having an inner wall of magnetic material. Subsequent to this sintering step, one could build additional metal electrodes on the top and bottom surfaces of the laminate 65, besides forming the electrodes from the co-sintered metal sheets 61 and 63. The electrode on either top and/or bottom surface of the sintered laminate 65, could be made by chemical, photo-processing and etching. This will lead to the desired structure 90, for the metal/ferrite plate as shown in FIG. 7.

An alternate method of forming electrode forming metal/magnetic-ceramic laminate 90, could be done by forming at least one opening 23, in a metal sheet 21, and securing at least one non-magnetic dielectric layer 31, to the electrode forming metal sheet 21. One could then form at least one opening 42, in the dielectric layer 31, such as, by punching. The opening 42, corresponds to at least one opening 23, in the secured metal sheet 21, to obtain an unsintered sub-laminate structure like 40. One could then build a multi-laminate structure consisting of at least two structures like 40, with dielectric layers 31, secured to each other with all holes aligned, and sintering the electrode forming metal/dielectric layer assembly with holes to full densification. Subsequently, one could fill the holes in the multi-laminate structure with at least one permanent ceramic magnet material, preferably a ferrite in at least one opening in the electrode forming metal/dielectric layers, extending through top and bottom surfaces of the sintered multi-laminate structure. At this point at least one opening is formed in the at least one ceramic permanent magnet material. Now, the electrode forming metal/dielectric layers with the screened ceramic permanent magnet material is sintered, and thereby forming the metal/magnetic-ceramic laminate with at least one discretely distributed magnet(s). Subsequent to this sintering step, one could build metal electrodes on the top and bottom surfaces of the laminate 65, using the electrode forming metal sheets 61 and 63. The electrode on either top and/or bottom surface of the sintered laminate 65, could be made by chemical, photo-processing and etching. This will lead to the desired structure 90 for the metal/ferrite plate as shown in FIG. 7.

Figure 7:
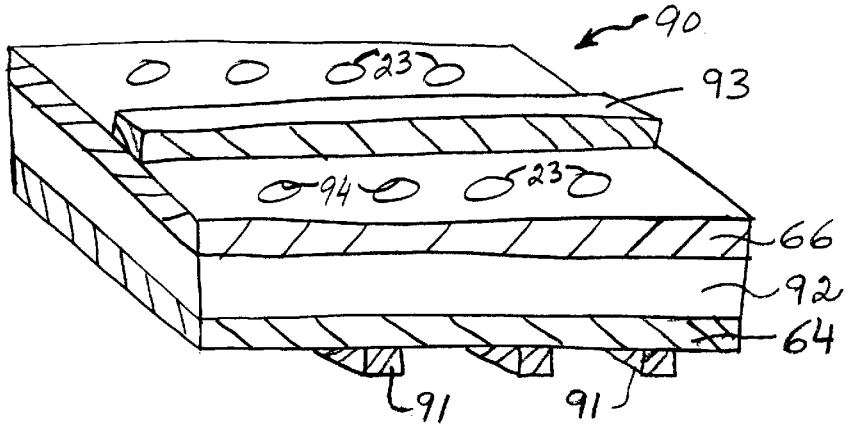
FIG. 7, illustrates a detailed perspective view of the inventive structure of the electrode forming magnetic-ceramic laminate with at least one hole per magnet wherein the hole extends between the poles of the magnet.

FIG. 7, shows a perspective view of the inventive structure of the electrode forming metal/magnetic-ceramic laminate 90, with at least one hole or opening per pixel. The laminate 90, can be built with a first or bottom co-sintered metal electrode 91, on the bottom surface, a second or top co-sintered metal electrode 93, on the top surface, at least one dielectric layer 64 and/or 66, and forming least one ceramic magnet 90. The magnet 90, has at least one pixel well 23, having inner wall 94, that extend from one end of the magnetic pole to the opposite end of the magnet, which is the boundary of the hole 23. The electrons from the electron beam 14, are channeled through the hole 23, defined by the magnetic inner wall 94. In a typical 17 inches or 21 inches diagonal display, the MMD laminate 90, may contain over one or two million holes 23. It is preferred that there be a hole per pixel and a magnet wall 94, per pixel. The laminate 90, is very flat and is manufactured with compatible materials that can be co-sintered. For example, the metal/metal electrode 91 and 93, can be nickel, palladium, silver or gold, the dielectric layer 64 and/or 66, could be a ceramic layer 64 and/or 66, which can be alumina, glass ceramic, nickel oxide, titanium oxide or titanium nitride, and the magnet 92, can be a ferrite or ferrite with glass, to name a few.

For some applications the electrode forming metal sheet 21, could act as an electron sink.

For some applications the electrode forming metal sheet 21, could act as a heat spreader.

The electrode forming metal sheet 21, could be used to act as a stiffener to prevent any distortion of the laminate magnet 90.

At least one electrically conductive metal could be bonded or co-sintered to at least one surface of the unsintered or sintered metal/ferrite laminate magnet 90.

At least one anode 22, could also be co-sintered/secured to the sintered or unsintered metal/ferrite laminate magnet 90. The anode 22, could be formed using a process selected from a group comprising photo-processing or chemical etching.

At least one control grid 15, could also be co-sintered/secured to the sintered or unsintered metal/ferrite laminate magnet 90. The control grid 15, could be formed using a process selected from a group comprising photo-processing or chemical etching.

A metal sheet 21, having at least one opening 23, as shown in FIG. 2, could be used as a mask to form at least one layer of phosphor coating 24, on at least one screen 20. The laminate magnet 90, could also be used as a mask to form at least one layer of the phosphor coating 24, on at least one screen 20. For some applications a display device could be made by positioning a phosphor coated screen 20, adjacent to the face of the magnet carrying the anode means 22, and evacuating the spaces between the electron source 12, and between the laminate magnet 90, and the screen 20.

The opening 23, in the composite magnetic material 90, could be formed by partially sintering the ferritic material and using a pressurized impinging medium to create the openings 23. The cross-section of the opening 23, could be selected from a group comprising circular cross-section, polygonal cross-section, triangular cross-section, rectangular cross-section, to name a few.

In another alternative method, one could build the structure 90, as shown in FIG. 7, by using the conventional thin film approach like CVD (chemical vapor deposition) to form the permanent magnet material around the surface with at least one opening 23.

And yet another alternate method of forming electrode forming metal/magnetic-ceramic laminate 90, could be done by forming at least one opening 23, in a electrode forming metal sheet 21, and securing at least one non-magnetic dielectric layer 31, and/or at least one ferrite layer 33, to the electrode forming metal sheet 21. One could then form at least one opening 42, in the dielectric layer 31 and/or the ferrite layer 33, such as, by punching. The opening 42, corresponds to at least one opening 23, in the secured metal sheet 21, to obtain an unsintered sub-laminate structure like 40. One could then build a multi-laminate structure consisting of at least two structures like 40, with dielectric layers 31, and the ferrite layers 33, secured to each other with all holes aligned, and sintering the electrode forming metal/dielectric assembly assembly with holes to full densification. Subsequently, one could deposit the permanent magnet material by CVD techniques on the side walls of the sintered openings 23 and 42. Subsequent to this CVD step, one could build metal electrodes on the top and bottom surfaces of the laminate 65, using the electrode forming metal sheets 61 and 63. The electrode on either top and/or bottom surface of the sintered laminate 65, could be made by chemical, photo-processing and etching. This will lead to the desired structure 90 for the metal/ferrite plate as shown in FIG. 7.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A display device comprising an electron source, said electron source comprising:

at least one cathode means and at least one electrode forming metal/ferrite laminate magnet comprising at least one metal sheet, at least one ceramic magnet layer, and at least one dielectric layer disposed between said metal sheet and said ceramic magnet layer, each of said layers having at least one opening in registration with each other, said electrode forming metal/ferrite laminate magnet having at least one opening which extends between opposite poles of said magnet creating at least one magnetic channel, wherein said magnetic channel allows the flow of electrons received from said cathode means into at least one electron beam towards at least one target.

2. The display device of claim 1, further comprising at least one co-sintered grid electrode means disposed between said cathode means and said magnet for controlling the flow of electrons from said cathode means into said magnetic channel.

3. The display device of claim 2, wherein said magnetic channel is disposed in said magnet in a two dimensional array of rows and columns.

4. The display device of claim 1, wherein said magnet has grid electrode means, and wherein said grid electrode means comprises a plurality of parallel row conductors and a plurality of parallel column conductors arranged orthogonally to said row conductors, and wherein each magnetic channel is located at a different intersection of a row conductor and a column conductor.

5. The display device of claim 4, wherein said grid electrode means is disposed on said cathode means facing said magnet.

6. The display device of claim 4, wherein said grid electrode means is disposed on said magnet facing said cathode means.

7. The display device of claim 4, wherein said grid electrode means is formed from a co-sintered metal sheet.

8. The display device of claim 7, wherein said electrode is formed from said co-sintered metal sheet using a process selected from a group consisting of photo-processing and chemical etching.

9. The display device of claim 1, wherein said cathode means comprises a field emission device.

10. The display device of claim 1, wherein said cathode means comprises a photo cathode.

11. The display device of claim 1, wherein at least one of said magnetic channel varies in cross-section area along its length.

12. The display device of claim 1, wherein at least one of said magnetic channel is tapered, and wherein an end of said channel having largest cross-section area faces said cathode means.

13. The display device of claim 1, wherein cross-section shape of said magnetic channel is selected from a group consisting of circular cross-section, polygonal cross-section, triangular cross-section or rectangular cross-section.

14. The display device of claim 1, wherein corners and edges of each said magnetic channel are chamfered.

15. The display device of claim 1, wherein said magnet comprises a stack of perforated laminates, said perforations in each laminate being aligned with said perforations in an adjacent laminate to continue said channel through said stack.

16. The display device of claim 15, wherein each laminate in said stack is separated from an adjacent laminate by at least one spacer.

17. The display device of claim 1, wherein said electrode forming metal sheet provides equi-potential surfaces for uniform electron acceleration.

18. The display device of claim 1, further comprising at least one anode means secured to said magnet remote from said cathode means for accelerating electrons through said magnetic channels.

19. The display device of claim 18, wherein said at least one anode means comprises lateral formations surrounding corners of said channels.

20. The display device of claim 19, farther comprising at least one deflection means for applying a deflection voltage across said first and second anodes to deflect electron beams emerging from said channels.

21. The display device of claim 20, further comprising:

means for supplying control signals to said grid electrode means, wherein said target is a screen for receiving electrons from at least one electron source, said screen having a phosphor coating facing a side of said magnet remote from said cathode, and wherein said anode means selectively controls the flow of electrons from said cathode to said phosphor coating via said at least one magnetic channel, thereby producing an image on said screen.

22. The display device of claim 21, comprising at least one anode layer disposed on said at least one phosphor coating.

23. The display device of claim 21, wherein said screen is arcuate in at least one direction.

24. The display device of claim 21, wherein said screen is arcuate in at least one direction and each interconnection between adjacent first anodes and between adjacent second anodes comprises a resistive element.

25. The display device of claim 21, comprising means for dynamically varying a DC level applied to said anode means to align electrons emerging from said channels with said phosphor coating on said screen.

26. The display device of claim 21, comprising an aluminum backing adjacent said phosphor coating.

27. The display device of claim 21, wherein said phosphor coating comprises a plurality of groups of different phosphors, said groups being arranged in a repetitive pattern, each group corresponding to a different channel;

and wherein said display device further comprises:

means for supplying control signals to said grid electrode means and said anode means to selectively control flow of electrons from said cathode to said phosphor coating via said channel;

and deflection means for supplying deflection signals to said anode means to sequentially address electrons emerging from said channel to different ones of said phosphors for said phosphor coating thereby to produce a color image on said screen.

28. The display device of claim 27, wherein said phosphors comprises a single color phosphors.

29. The display device of claim 27, wherein said phosphors comprises red, green, and blue phosphors.

30. The display device of claim 27, wherein said deflection means is arranged to address electrons emerging from said channel to different ones of said phosphors in said repetitive sequence red, green, red, blue, . . . .

31. The display device of claim 27, comprising a final anode layer disposed on said phosphor coating.

32. The display device of claim 27, wherein said screen is arcuate in at least one direction.

33. The display device of claim 27, wherein said screen is arcuate in at least one direction and each interconnection between adjacent first anodes and between adjacent second anodes comprises a resistive element.

34. The display device of claim 27, comprising means for dynamically varying a DC level applied to said anode means to align electrons emerging from said channels with said phosphor coating on said screen.

35. The display device of claim 27, comprising an aluminum backing adjacent said phosphor coating.

36. A computer system comprising: memory means; data transfer means for transferring data to and from said memory means; processor means for processing data stored in said memory means; and a display device of claim 27, for displaying data processed by said processor means.

37. A computer system comprising: memory means; data transfer means for transferring data to and from said memory means; processor means for processing data stored in said memory means; and a display device of claim 21, for displaying data processed by said processor means.

38. The display device of claim 21, wherein said phosphor coating comprises a single color phosphors.

39. The display device of claim 38, wherein said phosphors comprises Red, Green, and Blue phosphors.

40. The display device of claim 39, wherein said deflection means is arranged to address electrons emerging from said magnetic channel to different ones of said phosphors in said repetitive sequence Red, Green, Red, Blue, . . . .

41. A print-head comprising said electron source of claim 1.

42. A document processing apparatus comprising a print-head of claim 41, and means for supplying data to said print-head to produce a printed record in dependence on said data.

43. The display device of claim 1, wherein vacuum is maintained between said cathode and said magnet.

* * * * *